US006286624B1

(12) United States Patent
Bowles

(10) Patent No.: US 6,286,624 B1
(45) Date of Patent: Sep. 11, 2001

(54) METHODS AND APPARATUS FOR MOUNTING A WORK PLATFORM TO A LADDER

(76) Inventor: Dennis I. Bowles, H.C.R. 87, Box 5205, Potosi, MO (US) 63664

( * ) Notice: Subject to any disclaimer, the term of this patent is extended or adjusted under 35 U.S.C. 154(b) by 0 days.

(21) Appl. No.: 09/361,840

(22) Filed: Jul. 27, 1999

(51) Int. Cl.[7] ..... E06C 7/16
(52) U.S. Cl. ..... 182/117; 182/121
(58) Field of Search ..... 182/117, 121–7, 182/123, 118

(56) References Cited

U.S. PATENT DOCUMENTS 328,999 * 10/1885 Ballmann ..... 182/121
510,194 * 12/1893 Sellers ..... 182/121
2,485,685 * 10/1949 Armstrong ..... 182/121
4,179,011 * 12/1979 Morawski ..... 182/206

FOREIGN PATENT DOCUMENTS

1363224 * 8/1974 (GB) ..... 182/121
2194983 * 3/1988 (GB) ..... 182/117
6280383 * 10/1994 (JP) ..... 182/117

* cited by examiner

*Primary Examiner*—Alvin Chin-Shue
(74) *Attorney, Agent, or Firm*—ArmstrongTeasdale LLP

(57) ABSTRACT

A mounting system for mounting a work platform to a ladder includes a support system, a rod, and a suspension mount. The support system includes a plurality of members which attach to the work platform and attach to the ladder. The rod is configured to attach the support system to the ladder and is further configured to extend through one of the ladder rungs. The suspension mount attaches to the support system and includes a locking mechanism, a hook assembly, and an adjustable telescoping member. The hook assembly fits over and around the ladder rung.

16 Claims, 5 Drawing Sheets

METHODS AND APPARATUS FOR MOUNTING A WORK PLATFORM TO A LADDER

BACKGROUND OF THE INVENTION

This invention relates generally to mounting systems and, more particularly, to mounting systems for mounting a work platform to a ladder.

When performing work around a building, it is often desirable to use a scaffold or an extension ladder to work on areas of the building that are elevated from the ground. However, most scaffolds are relatively complex structures which are relatively expensive, difficult to move, and difficult to assemble. Furthermore, extension ladders do not provide a large work platform, are awkward to work from, and must be moved frequently if the work area is large. Additionally, it is often difficult to make the scaffold or the extension ladder stand steady, particularly when the ground adjacent the building is uneven.

As a result, combination ladder and scaffold systems are used. Combination systems typically include two ladders which each support one end of a board or work platform. Typically, the work platform merely rests on the rungs of the two ladders, and is subject to slipping from the rungs. Such systems are intrinsically unsafe, provide work platforms which are awkward to work from, and are unreliable.

BRIEF SUMMARY OF THE INVENTION

In an exemplary embodiment, a mounting system for mounting a work platform to a ladder includes a support system, a rod, and a suspension mount. The support system includes a plurality of members which attach to the work platform and attach to the ladder. The rod is configured to attach the support system to the ladder and is further configured to extend through one of the ladder rungs. The suspension mount attaches to the support system and to the ladder rung.

In operation, the suspension mount is attached to the ladder rung with a hook assembly. The support system includes a first member which is suspended generally perpendicularly to the ground from the hook assembly. A second member is mounted substantially perpendicularly to the first member and is easily adjustable. A third member extends generally perpendicularly from the second member towards an upright rail on the ladder. A fourth member extends generally perpendicularly from the second member towards the opposite upright ladder rail. A rod is extended through the third member, the ladder rung, and the fourth member. As a result, the mounting system eliminates more costly and more complicated known work platform positioning systems and provides a mounting system that is highly reliable, cost-effective, and easily assembled.

DETAILED DESCRIPTION OF THE INVENTION

Figure 1:
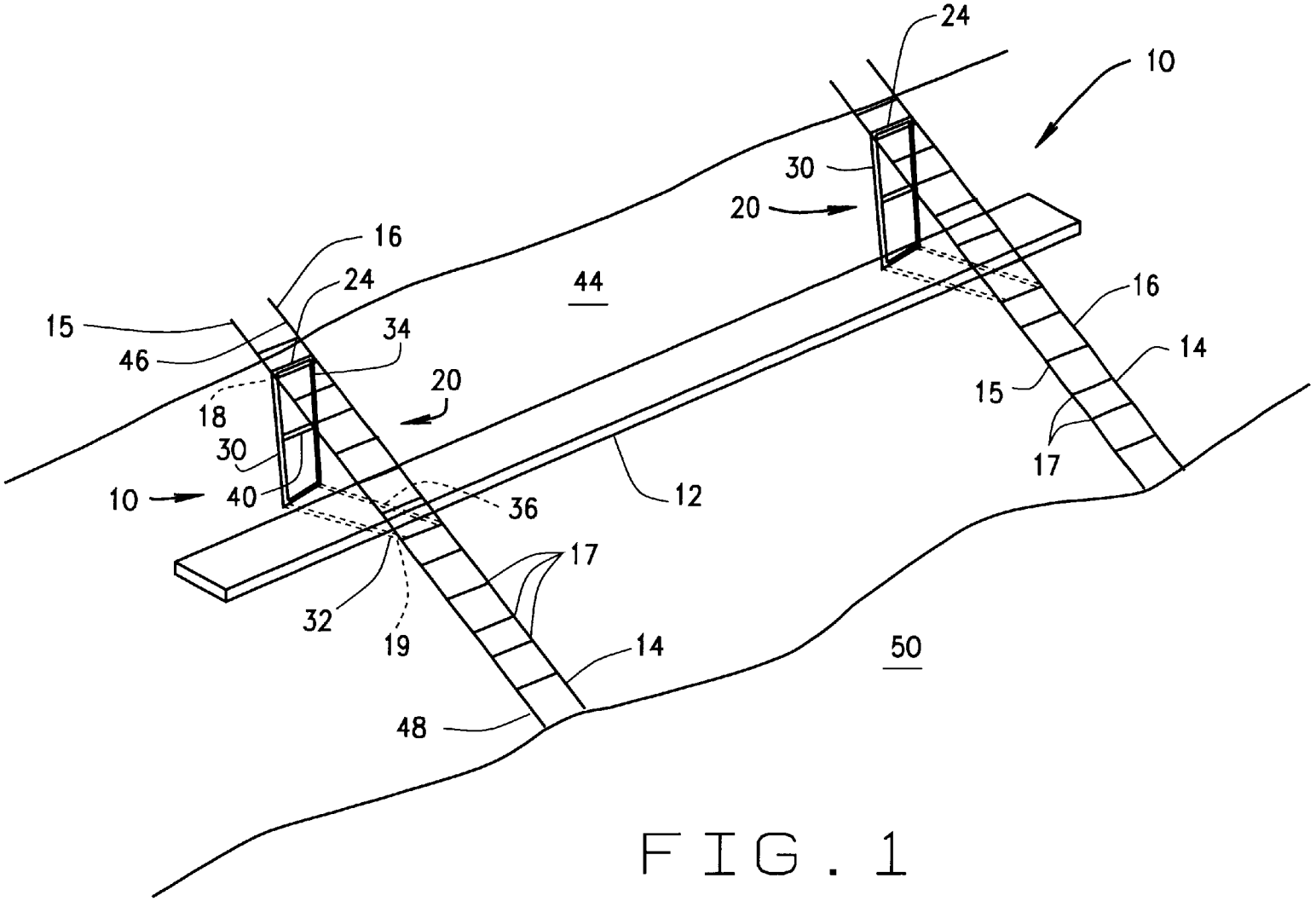
FIG. 1 is a perspective view of a mounting system for mounting a work platform to a ladder in accordance with one embodiment of the present invention.

FIG. 1 is a perspective view of a mounting system 10 for mounting a work platform 12 to a ladder 14. Ladder 14 can be a straight ladder or an extension ladder and includes a pair of upright supports 15 and 16, and a plurality of hollow rungs 17. Hollow rungs 17 include a first rung 18 and a second rung 19. Mounting system 10 includes a support system 20 to attach to ladder 14, a rod (not shown in FIG. 1) to secure support system 20 to ladder 14, and a suspension mount 24 to attach support system 20 to ladder rung 18. Support system 20 includes a first member 30, a second member 32, a third member 34, and a fourth member 36. First member 30 is mounted substantially perpendicularly to second member 32 and third member 34 is mounted substantially perpendicularly to fourth member 36. First member 30 is substantially parallel to third member 34 and second member 32 is substantially parallel to fourth member 36. A fifth member 40 is attached between first member 30 and third member 34 such that fifth member 40 is substantially perpendicular to first member 30 and third member 34.

In operation, ladder 14 is leaned in position against a structure 44. Ladder 14 has a first end 46 and a second end 48. In operation, first end 46 is elevated above a floor 50 and is in close proximity with structure 44 while second end 48 remains in contact with floor 50. Mounting system 10 is attached to ladder 14 with support system 20. Support system suspension mount 24 is attached to ladder rung 18 so that when first member 30 and third member 34 are attached, first member 30 and third member 34 are suspended from first rung 18 generally perpendicularly towards floor 50. Second member 32 and fourth member 36 are attached to second rung 19 such that second member 32 extends generally perpendicularly from first member 30 to ladder 14 and fourth member 36 extends generally perpendicularly from third member 34 to ladder 14. Furthermore, when mounting system 10 is attached, second member 32 and fourth member 36 are generally parallel to floor 50. As such, when work platform 12 is attached to mounting system 10, work platform 12 is generally parallel to floor 50.

Figure 2:
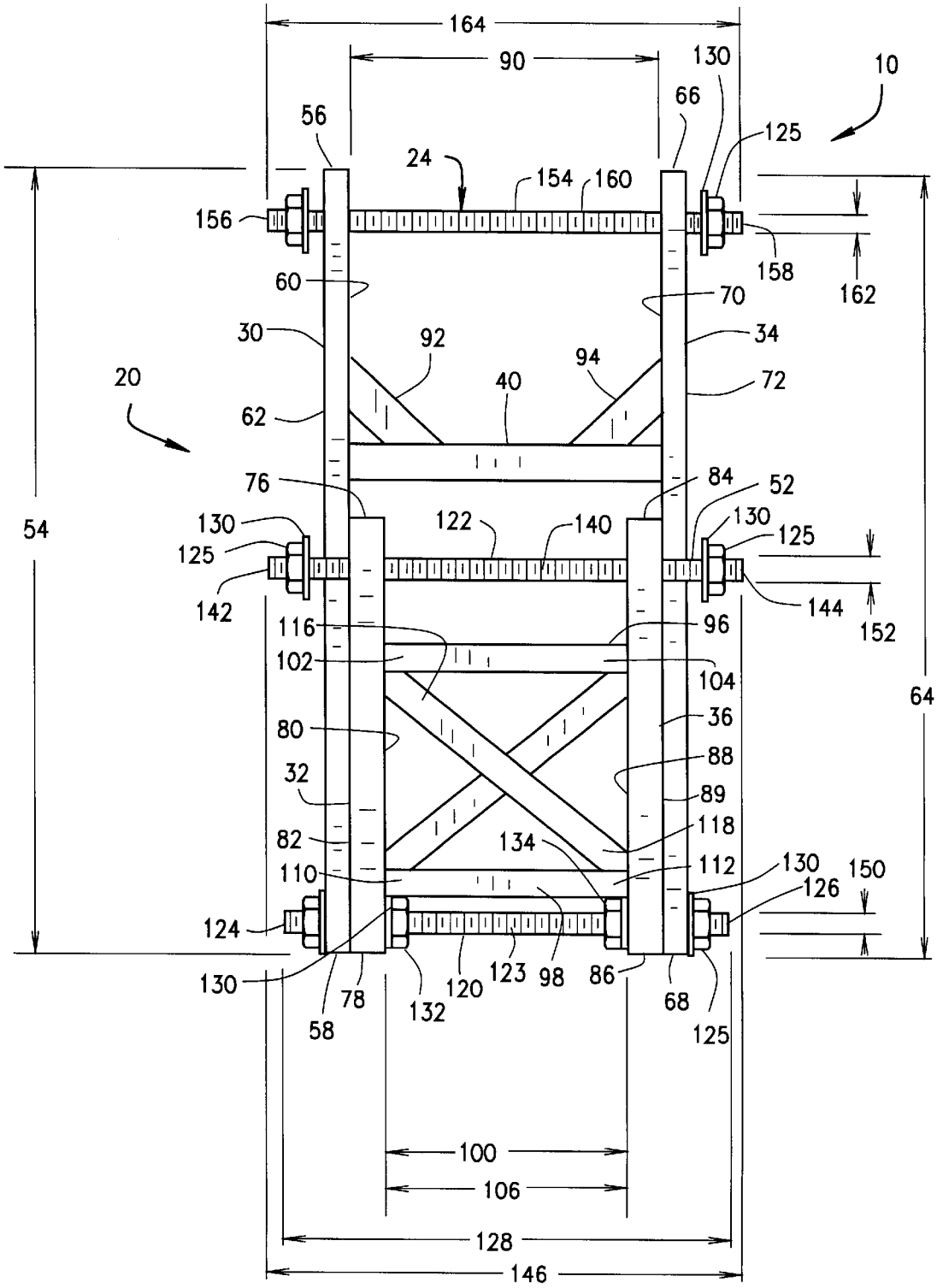
FIG. 2 is a front elevational side view of the mounting system shown in FIG. 1 in a stored position.

FIG. 2 is a front elevational side view of mounting system 10 shown in a stored position 52. First member 30 of mounting system 10 has a length 54 and includes a first end 56, a second end 58 attached to second member 32, an inner surface 60, and an outer surface 62. Third member 34 has a length 64 and includes a first end 66, a second end 68 attached to fourth member 36, an inner surface 70, and an outer surface 72. In one embodiment, length 54 is substantially equal to length 64 and is approximately 60 inches. Second member 32 has a first end 76 attached to first member 30, a second end 78, an inner surface 80, and an outer surface 82. Fourth member 36 includes a first end 84 attached to third member 34, a second end 86, an inner surface 88, and an outer surface 89. In one embodiment, first member 30, second member 32, third member 34 and fourth member 36 have rectangular cross-sectional profiles. In another embodiment first member 30, second member 32, third member 34 and fourth member 36 are constructed from wood. In another embodiment first member 30, second member 32, third member 34 and fourth member 36 are constructed from plastic. In yet another embodiment, first member 30, second member 32, third member 34 and fourth member 36 are constructed from a metal, such as aluminum or steel.

Fifth member 40 extends between first member 30 and third member 34 to provide additional support to first member 30 and third member 34. Fifth member 40 has a length 90 and includes a pair of angled braces 92 and 94. In one embodiment, length 90 is approximately 21⅜ inches. Brace 92 is attached between fifth member 40 and first member 30. Brace 94 extends between fifth member 40 and third member 34.

A pair of braces 96 and 98 are attached between second member 32 and fourth member 36. Braces 96 and 98 are mounted generally perpendicularly to second member 32 and fourth member 36 to provide additional structural support to mounting system 10. Brace 96 has a length 100 and includes a first end 102 attached to second member 32 and a second end 104 attached to fourth member 36. Brace 98 has a length 106 and includes a first end 110 attached to second member 32 and a second end 112 attached to fourth member 36. In one embodiment, length 100 is substantially equal to length 106 and is approximately 18 inches. A pair of cross braces 116 and 118 extend between second member 32 and fourth member 36 and between brace 96 and brace 98 respectively. Cross brace 116 extends from first end 102 of brace 96 to second end 112 of brace 98. Cross brace 118 extends from first end 110 of brace 98 to second end 104 of brace 96.

Mounting system 10 includes a first rod 120 and a second rod 122. First rod 120 includes threads 123 sized to receive nuts 125 and has a first end 124 positioned in close proximity to first member second end 58, a second end 126 positioned in close proximity to third member second end 68. First rod 120 also has a length 128. In one embodiment length 128 is approximately 27 inches.

In operation, rod 120 is inserted through first member 30, second member 32, a washer 130, a first retainer nut 132, a second retainer nut 134, another washer 130, fourth member 36, and third member 34. Rod length 128 is such when rod 120 is fully inserted, rod first end 124 extends beyond first member outer surface 62 and rod second end 126 extends beyond third member outer surface 72. Washers 130 are inserted on rod first end 124 and rod second end 126. Nut 125 is tightened on rod first end 124 against washer 130 which is positioned adjacent first member outer surface 62. Another nut 125 is tightened on rod second end 126 against washer 130 which is positioned adjacent third member outer surface 72. Retainer nut 132 is tightened against washer 130 which is adjacent second member inner surface 80. Retainer nut 134 is tightened against washer 130 which is positioned adjacent fourth member inner surface 88. Nuts 125 and retainer nuts 132 and 134 are tightened on rod 120 to create a hinge which enables second member 32 to rotate with respect to first member 30 and fourth member 36 to rotate with respect to third member 34. Braces 96 and 98 and cross braces 116 and 118 ensure that second member 32 rotates simultaneously with fourth member 36 and that second member 32 remains substantially parallel to fourth member 36. Rod 120 also enables second member 32 and fourth member 36 to be fully rotated to stored position 52 wherein second member 32 and fourth member 36 are positioned adjacent first member 30 and third member 34.

Rod 122 includes threads 140 sized to receive nuts 125, a first end 142 positioned in close proximity to second member first end 74, and a second end 144 positioned in close proximity to fourth member first end 84. Additionally, rod 122 has a length 146. In one embodiment, length 146 is approximately 27 inches. Rods 120 and 122 have diameters 150 and 152 respectively which are substantially equal. In one embodiment diameters 150 and 152 are approximately 0.5 inches.

Suspension mount 24 includes a rod 154 which has a first end 156 positioned in close proximity to first member first end 56 and a second end 158 positioned in close proximity to third member first end 66. Rod 154 includes threads 160 sized to engage nuts 125. Additionally, rod 154 has a diameter 162 and a length 164. In one embodiment, diameter 162 is approximately 0.5 inches and length 164 is approximately 27 inches.

In operation, rod 154 is inserted through first member 30, first rung 18, and third member 34. First member inner surface 60 is positioned adjacent ladder upright support 15 and third member inner surface 70 is positioned adjacent upright support 16. Rod length 164 is such that when rod 154 is fully inserted, rod first end 156 extends beyond first member outer surface 62 and rod second end 158 extends beyond third member outer surface 72. Washers 130 are installed on rod first end 156 and rod second end 158. Nut 125 is tightened on rod fist end 156 against washer 130 which is positioned adjacent first member outer surface 62. Another nut 125 is tightened on rod second end 158 against washer 130 which is positioned adjacent third member outer surface 72.

After rod 154 is attached to ladder 14 (as described above), second member 32 and fourth member 36 are rotated substantially perpendicularly to first member 30 and third member 34. Rod 122 then attaches mounting system 10 to ladder 14. Rod 122 is inserted through second member 32, ladder rung 19, and fourth member 36. Second member inner surface 80 is positioned adjacent ladder upright support 15 and fourth member inner surface 88 is positioned adjacent upright support 16. Rod length 146 is such that when rod 122 is fully inserted, rod first end 142 extends beyond second member outer surface 82 and rod second end 144 extends beyond fourth member outer surface 89. Washers 130 are installed on rod first end 142 and rod second end 144. Nut 125 is tightened on rod first end 142 against washer 130 which is positioned adjacent second member outer surface 82. Another nut 125 is tightened on rod second end 144 against washer 130 which is positioned adjacent fourth member outer surface 89.

Figure 3:
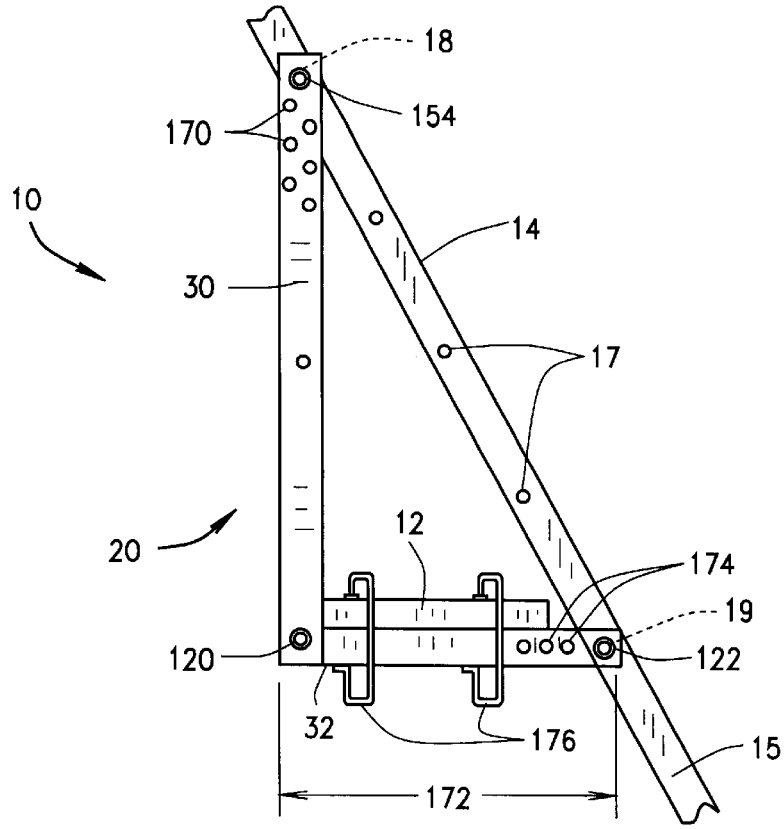
FIG. 3 is a side elevational view of the mounting system shown in FIG. 1 attached to a ladder.

FIG. 3 is a side elevational view of mounting system 10 including ladder 14 which includes hollow ladder rungs 17 and upright support 15. Support system 20 includes first member 30 and second member 32. First member 30 includes a plurality of openings 170 sized to receive suspension mount rod 154. Second member 32 has a length 172 and includes a plurality of openings 174 sized to receive rod 122. In one embodiment, length 172 is approximately 33 inches.

In operation, the combination of openings 170 and 174 and the hinge action of rod 120, permits support system 20 to be adjusted such that first member 30 remains suspended from ladder 14 and is substantially perpendicular to the floor (not shown in FIG. 3) while second member 32 is positioned substantially parallel to the floor. As such, when work platform 12 is secured to mounting system 10 with a plurality of fastener assemblies 176, work platform 12 is substantially parallel to the floor. In one embodiment, fastener assemblies 176 are C-clamps. In another embodiment, fastener assemblies 176 are U-bolts.

Figure 4:
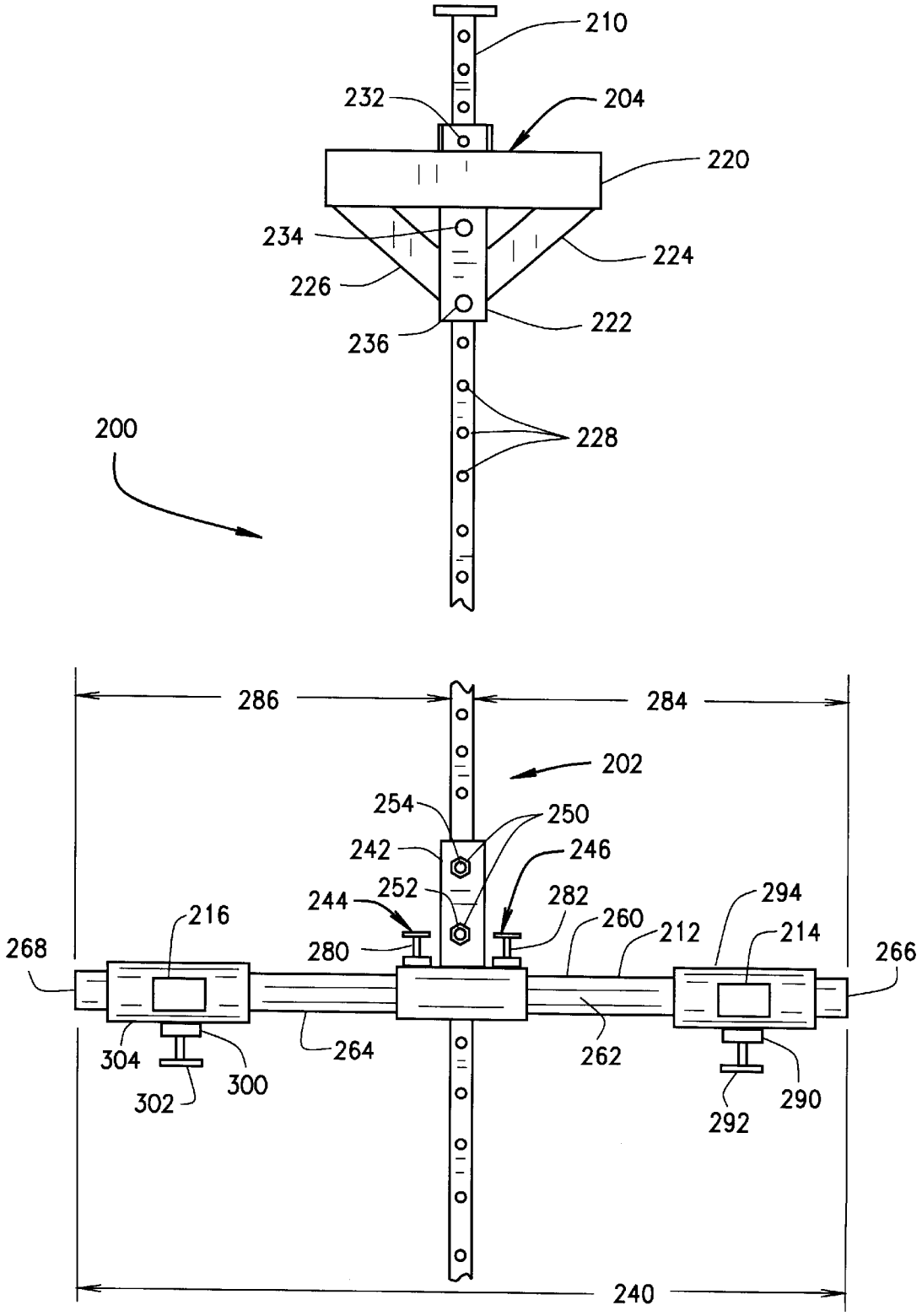
FIG. 4 is a front view of a mounting system for mounting a work platform to a ladder in accordance with a second embodiment of the present invention.

FIG. 4 is a front view of an alternative embodiment of a mounting system 200 for mounting work platform 12 (shown in FIG. 1) to a ladder 14 (shown in FIG. 1). Mounting system 200 includes a support system 202 attached to ladder 14, a rod (not shown in FIG. 4) which extends through a ladder rung 18 (not shown in FIG. 4), and a suspension mount 204 which attaches support system 202 to a ladder rung. Support system 202 includes a first member 210, a second member 212, a third member 214, and a fourth member 216. First member 210 is attached substantially perpendicular to second member 212. Third member 214 and fourth member 216 extend substantially perpendicularly from second member 212.

Suspension mount 204 includes a hook assembly 220, a telescoping member 222, a cross brace 224 attached between telescoping member 222 and hook assembly 220, and a cross brace 226 attached between telescoping member 222 and hook assembly 220. First member 210 has a rectangular cross-sectional profile and includes a plurality of openings 228. Telescoping member 222 has a rectangular cross-sectional profile that is sized slightly larger than the rectangular cross-sectional profile of first member 210. As such, telescoping member 222 includes an inner surface (not shown) which is in slidable contact with an outer surface (not shown) of the rectangular cross-sectional profile of first member 210. Telescoping member 222 includes three locking members 232, 234, and 236 which extend through telescoping member 222 to secure telescoping member 222 to first member 210. Openings 228 are sized and spaced to receive locking members 232, 234, and 236. Hook assembly 220 is sized to fit over and around the ladder rung.

Second member 212 has a length 240, and includes a telescoping member 242, a first bracket 244, and a second bracket 246. Telescoping member 242 has a rectangular cross-sectional profile that is sized larger than the rectangular cross-sectional profile of first member 210. As such, an inner surface (not shown) of the second member telescoping member 242 is in slidable contact with the outer surface (not shown) of the rectangular cross-sectional first member 210. Telescoping member 242 includes a plurality of openings 250 sized to receive a bolt assembly 252. Bolt assembly 252 is inserted through opening 250, opening 228, and first member 210. A nut 254 is attached to bolt assembly 252 to secure telescoping member 242 in position on first member 210. Second member 212 is welded to telescoping member 242 such that second member 212 is substantially perpendicular to first member 210.

Second member 212 also includes a top surface 260, a front surface 262, a bottom surface 264, and a back surface (not shown) and has a first end 266 and a second end 268. Second member 212 is slidable relative to first member 210 and is anchored in position with bracket assemblies 244 and 246. Bracket assemblies 244 and 246 include T-bolts 280 and 282 respectively which are inserted through bracket assemblies 244 and 246 to contact top surface 260. T-bolts 280 and 282 are tightened against top surface 260 to anchor second member 212 relative to first member 210. Once T-bolts 280 and 282 are tightened, second member 212 has a first length 284 which extends from first member 210 to second member first end 266 and a second length 286 which extends from first member 210 to second member second end 268.

Third member 214 includes bracket assembly 290 which includes T-bolt 292 and telescoping member 294. Telescoping member 294 has a rectangular cross-sectional profile which is larger than the rectangular cross-sectional profile of second member 212. As such, an inner surface (not shown) of telescoping member 294 is in slidable contact with second member top surface 260, front surface 262, bottom surface 264, and the back surface. Third member 214 is welded to telescoping member 294 such that third member 214 extends substantially perpendicularly from second member 212. T-bolts 292 extend through openings (not shown) in telescoping member 294 to contact second member bottom surface 264. Bracket assembly 290 permits third member 214 to be in slidable contact with second member 212 and to be fixedly positioned in any position within second member first length 284.

Fourth member 216 includes bracket assembly 300 which includes T-bolt 302 and telescoping member 304. Telescoping member 304 has a rectangular cross-sectional profile which is larger than the rectangular cross-sectional profile of second member 212. As such, an inner surface (not shown) of telescoping member 304 is in slidable contact with second member top surface 260, front surface 262, bottom surface 264, and the back surface. Fourth member 216 is welded to telescoping member 304 such that fourth member 216 extends substantially perpendicularly from second member 212. T-bolts 302 extend through openings (not shown) in telescoping member 304 to contact second member bottom surface 264. Bracket assembly 300 permits fourth member 216 to be in slidable contact with second member 212 and to be fixedly positioned in any position along second member second length 284.

Figure 5:
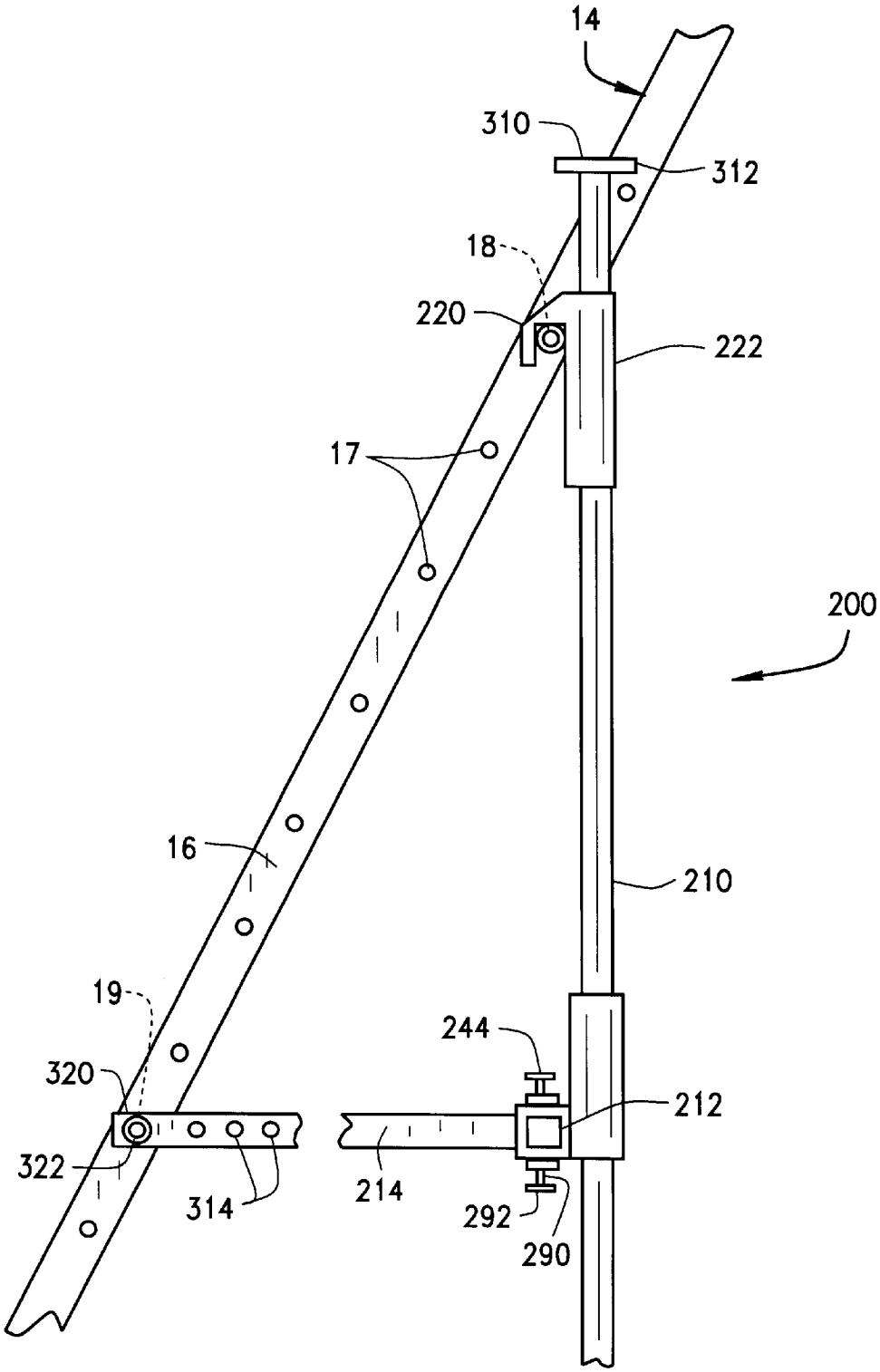
FIG. 5 is a side elevational view of the mounting system shown in FIG. 4 attached to a ladder.

FIG. 5 is a side elevational view of mounting system 200 attached to ladder 14 including rungs 17. First member 210 includes a first end 310 which includes a stop 312 which prevents telescoping member 222 from being repositioned beyond first member first end 310. Telescoping member 222 includes hook assembly 220 which is sized to fit over and around first rung 18. In one embodiment, telescoping member 222 is welded to first member 210 and as such is not adjustable. Third member 214 includes a plurality of openings 314 sized to receive a rod (not shown).

In operation, first member 210 is elevated upward from below ladder 14 between rungs 17 and 18 to permit hook assembly 220 to fit over and around ladder rung 18. Telescoping member 222 is then secured to first member 210 with locking members 233, 234, 236 (shown in FIG. 4) as first member 210 remains suspended from hook assembly 220. Second member 212 is then anchored to first member 210 with bracket 244 and bracket 246 (shown in FIG. 4). Second member 212 is positioned relative to first member 210 such that first member 210 remains suspended substantially perpendicular to the floor (not shown in FIG. 5) and further, such that third member 214 and the fourth member 216 (shown in FIG. 4) can engage ladder 14 and be positioned substantially parallel to the floor. Third member 214 is then positioned to be adjacent ladder upright support 16. Once positioned, third member 214 is anchored to second member 212 with bracket assembly 290 and T-bolt 292. Fourth member 216 is positioned and anchored similarly. A threaded rod (not shown) is inserted through third member 214, second rung 19, and fourth member 216. The rod has a length which permits a washer 320 to be inserted over each end of the rod and positioned against third member 214 and fourth member 216 respectively when the rod is fully inserted. A nut 322 is tightened on each end of the rod against each washer 320 to complete securing mounting system 200 to ladder 14.

Figure 6:
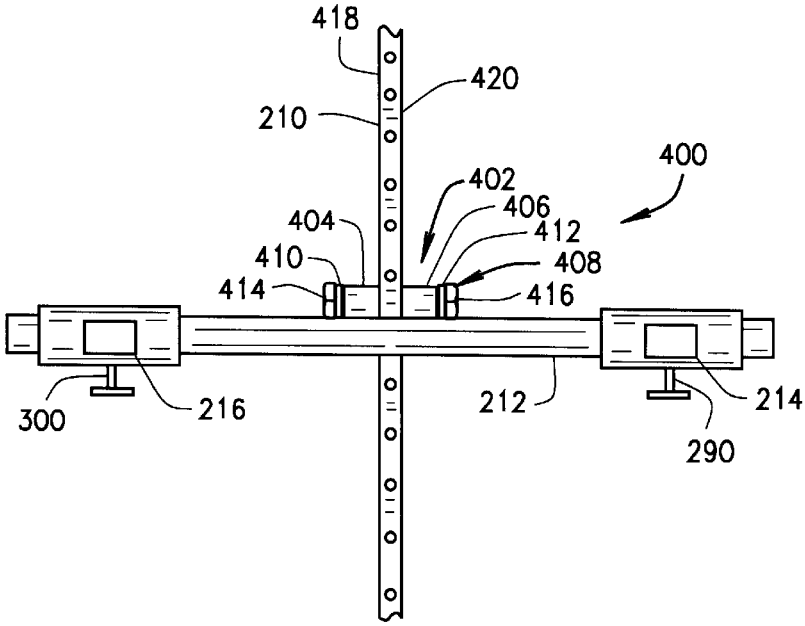
FIG. 6 is a partial enlarged front view of a mounting system for mounting a work platform to a ladder in accordance with a third embodiment of the present invention.

FIG. 6 is a partial front view of a third embodiment of a mounting system 400 for mounting a work platform (not shown in FIG. 6) to a ladder (not shown in FIG. 6). Mounting system 400 includes first member 210, second member 212, third member 214, and fourth member 216. Mounting system 400 also includes bracket assemblies 290 and 300 which anchor third member 214 and fourth member 216 to second member 212 respectively.

Second member 212 is welded to a hinge assembly 402 which includes a first pipe 404, a second pipe 406 and a pin assembly 408. Pin assembly 408 includes a pair of washers 410 and 412, a pair of nuts 414 and 416, and a threaded rod (not shown). First member 210 includes a plurality of openings (not shown) positioned on each sidewall 418 and 420 of first member 210. The openings are sized to receive the threaded rod.

In operation, the rod is inserted through pipe 404, the openings within first member 210, and through first member 210 and pipe 406. Pipe 406 and pipe 404 are positioned adjacent first member 210. Washers 410 and 412 are installed on each end of the threaded rod. Nuts 414 and 416 are installed on each respective end of the threaded rod and tightened against each respective washer 410 and 412. Hinge assembly 402 permits second member 212 to rotate with respect to first member 210. As such, third member 214 and fourth member 216 are rotated simultaneously.

The above described mounting system for mounting a work platform to a ladder is cost-effective and highly reliable. The mounting system includes a support system and a rod, which, in combination with a suspension mount reliably positions the mounting system to attach a work platform. Furthermore, the mounting system uses adjustable equipment that is inexpensive and reliable when compared to other types of elevated work platform systems currently in use. As such, a cost effective and reliable mounting system for mounting a work platform to a ladder is provided.

While the invention has been described in terms of various specific embodiments, those skilled in the art will recognize that the invention can be practiced with modification within the spirit and scope of the claims.

What is claimed is:

1. A mounting system for mounting a work platform to a ladder including at least a first and a second rung, said mounting system comprising:

a support system comprising a plurality of members, said members comprising at least a first member, a second member, a third member, and a fourth member, said first member mounted substantially perpendicularly to said second member and comprising a first end and a second end, said first member first and second ends comprising a plurality of first openings, said third member coupled to said second member such that said third member extends substantially perpendicularly from said second member, said fourth member coupled to said second member such that said fourth member extends substantially perpendicularly from said second member, said support system configured to attach to the ladder;

a rod configured to secure said support system to the ladder, said rod further configured to extend through the first rung; and a suspension mount comprising a hook assembly attached to said support system first member, said hook assembly configured to attach said first member to the second rung.

2. A mounting system in accordance with claim 1 wherein said suspension mount hook assembly sized to fit over and around the second rung, said hook assembly attached to at least one of said first member first end openings.

3. A mounting system in accordance with claim 2 wherein said third member comprises a third member bracket slidably mounted to said second member, said fourth member comprises a fourth member bracket slidably mounted to said second member, said third member bracket frictionally engaging said second member, said fourth member bracket frictionally engaging said second member.

4. A mounting system in accordance with claim 3 wherein said second member comprises a bracket slidably attached to said first member, said bracket comprising a fastener assembly secured to said first member.

5. A mounting system in accordance with claim 3 wherein said second member comprises a hinge assembly comprising a pair of brackets rotatably attached to said first member, a rod extending through said brackets and said first member, and at least one nut attached to said rod.

6. A mounting system in accordance with claim 2 wherein said first member is configured to be suspended from the second rung.

7. A mounting system in accordance with claim 2 wherein said third and fourth members configured to support the work platform.

8. A mounting system in accordance with claim 2 wherein said suspension mount slidably mounted to said support system first member.

9. A mounting system in accordance with claim 2 wherein said suspension mount hook assembly is substantially perpendicular to said support system first member.

10. A mounting system in accordance with claim 2 wherein said suspension mount hook assembly is substantially parallel to said support system second member.

11. A mounting system for a ladder including at least a first and a second rung, said mounting system comprising:

a work platform;

a support system comprising at least a first member, a second member, a third member, and a fourth member, said first member mounted substantially perpendicularly to said second member and comprising a first end and a second end, said first member first and second ends comprising a plurality of first openings, said third member coupled to said second member such that said third member extends substantially perpendicularly from said second member, said fourth member coupled to said second member such that said fourth member extends substantially perpendicularly from said second member, said support system configured to attach to the ladder, said work platform supported by said third and fourth members;

a rod configured to secure said support system to the ladder, said rod further configured to extend through the ladder first rung; and a suspension mount comprising a hook assembly attached to said support system first member, said suspension mount hook assembly configured to attach said first member to the second rung, such that said first member is suspended from the ladder second rung.

12. A mounting system in accordance with claim 11 wherein said suspension mount hook assembly sized to fit over and around the second rungs.

13. A mounting system in accordance with claim 12 wherein said third member substantially parallel with said fourth member, said third member slidably coupled to said second member, said fourth member slidably coupled to said second member.

14. A mounting system in accordance with claim 13 wherein said second member substantially coplanar with said third and fourth members.

15. A mounting system in accordance with claim 13 wherein said second member comprises a hinge assembly comprising a pair of brackets rotatably coupled to said first member.

16. A mounting system in accordance with claim 13 wherein said suspension mount slidably mounted to said first member.

* * * * *